US007422420B2

(12) United States Patent
Spaggiari

(10) Patent No.: US 7,422,420 B2
(45) Date of Patent: Sep. 9, 2008

(54) AXIAL FAN

(75) Inventor: Alessandro Spaggiari, Correggio (IT)

(73) Assignee: SPAL Automotive S.R.L., Correggio (IT)

( * ) Notice: Subject to any disclaimer, the term of this patent is extended or adjusted under 35 U.S.C. 154(b) by 413 days.

(21) Appl. No.: 10/570,169

(22) PCT Filed: Jul. 5, 2005

(86) PCT No.: PCT/IB2005/001898

§ 371 (c)(1),
(2), (4) Date: Mar. 1, 2006

(87) PCT Pub. No.: WO2006/006043

PCT Pub. Date: Jan. 19, 2006

(65) Prior Publication Data

US 2007/0258822 A1 Nov. 8, 2007

(51) Int. Cl.
*F04D 29/38* (2006.01)

(52) U.S. Cl. ..... 416/238; 416/DIG. 2

(58) Field of Classification Search ..... 416/238, 416/DIG. 2, DIG. 5

See application file for complete search history.

(56) References Cited

U.S. PATENT DOCUMENTS

| | | | | |
|---|---|---|---|---|
| 6,554,574 | B1 * | 4/2003 | Spaggiari | 416/238 |
| 6,558,123 | B1 * | 5/2003 | Spaggiari | 416/238 |
| 7,273,354 | B2 * | 9/2007 | Spaggiari | 416/238 |

FOREIGN PATENT DOCUMENTS

| | | | |
|---|---|---|---|
| DE | 37 24 319 | A1 | 2/1989 |
| EP | 0 553 598 | A1 | 8/1993 |
| EP | 0 704 626 | A2 | 4/1996 |
| EP | 0 945 625 | A1 | 9/1999 |

* cited by examiner

*Primary Examiner*—Richard Edgar
(74) *Attorney, Agent, or Firm*—Nath Law Group; Jerald L. Meyer; Derek Richmond

(57) ABSTRACT

An axial fan (1) rotating in a plane (XY) about an axis (2) comprises a central hub (3), a plurality of blades (4), which have a root (5) and a tip (6), the blades (4) being delimited by a convex leading edge (7) and by a concave trailing edge (8), their projections in the fan rotation plane each being formed by circular arc segments; the blades (4) are made from sections with aerodynamic profiles, each with decreasing length and more curved from the perimeter to the hub.

18 Claims, 3 Drawing Sheets

AXIAL FAN

TECHNICAL FIELD

The present invention relates to an axial fan with blades angled in the fan plane of rotation. The fan according to the present invention may be used in various applications, for example, to move air through a heat exchanger, or radiator, of a cooling system for the engine of a motor vehicle or the like; or to move air through the heat exchanger of the heating system and/or through the evaporator of the air conditioning system of the interior of a motor vehicle. Moreover, the fan according to the present invention may be used to move air in fixed air conditioning or heating systems for houses.

BACKGROUND ART

Fans of this type must satisfy various requirements, including: low noise level, high efficiency, compactness, capacity to achieve good pressure and flow rate values. In particular, achieving good general performance while keeping noise levels down requires careful design of the blades and the profiles of which they consist. A fan of this type is known from U.S. Pat. No. 6,241,474, which describes a low noise fan with blades whose angle or pitch decreases gradually from the hub to the tip over a predetermined extension of the radius, then their angle increases again towards the tip. The blades are connected to one another by an external ring.

DISCLOSURE OF THE INVENTION

One aim of the present invention is to provide a fan which has good general performance with a low noise level. According to one aspect of the present invention, an axial fan as specified in claim 1 is presented. The dependent claims refer to preferred and advantageous embodiments of the invention.

BRIEF DESCRIPTION OF THE DRAWINGS

The invention is described in more detail below with reference to the accompanying drawings, which illustrate a preferred, non-limiting embodiment, in which.

DETAILED DESCRIPTION OF THE PREFERRED EMBODIMENTS

Figure 1:
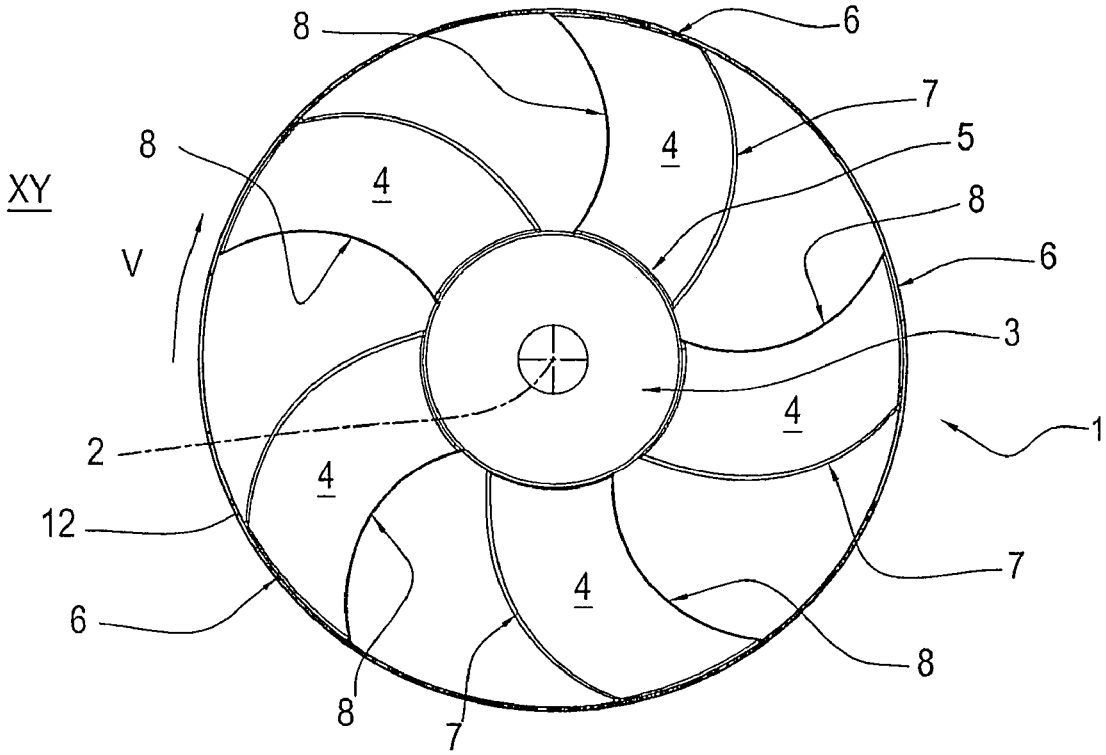
FIG. 1 is a front view of the fan in accordance with the present invention.

With reference to the accompanying drawings, the fan 1 rotates about an axis 2 and comprises a central hub 3 to which a plurality of blades 4 are connected, the blades being curved in the fan 1 plane of rotation XY.

The blades 4 have a root 5, a tip 6 and are delimited by a convex leading edge 7 and a concave trailing edge 8.

Figure 4:
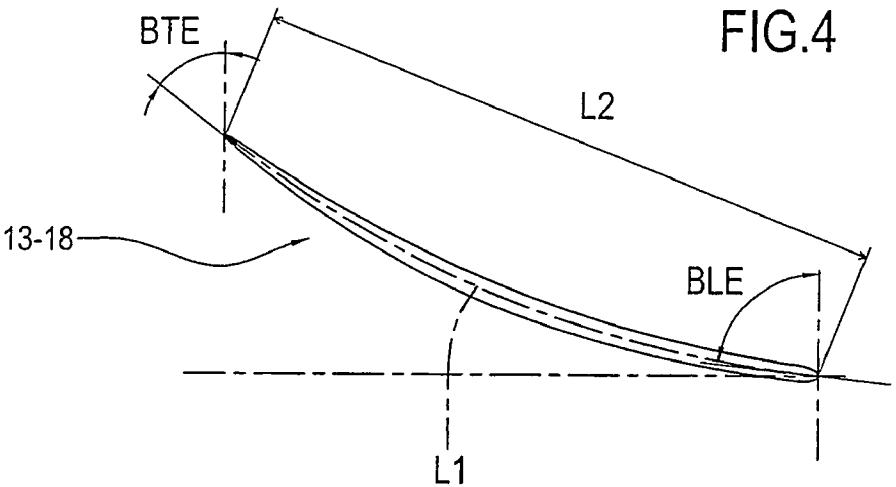
FIG. 4 is a cross-section of a profile and the respective geometric characteristics.

For the best results in terms of efficiency, flow rate and air pressure, the fan 1 rotates with a direction of rotation V, illustrated in FIGS. 1 and 4, so that the tip 6 of each blade 4 encounters the air flow after the root 5.

Maintaining the direction of rotation V, the fan 1 can be produced as a blowing fan or as a suction fan, by suitably modifying and adapting the profiles of the blades. The following description refers to a blowing fan by way of example.

Figure 2:
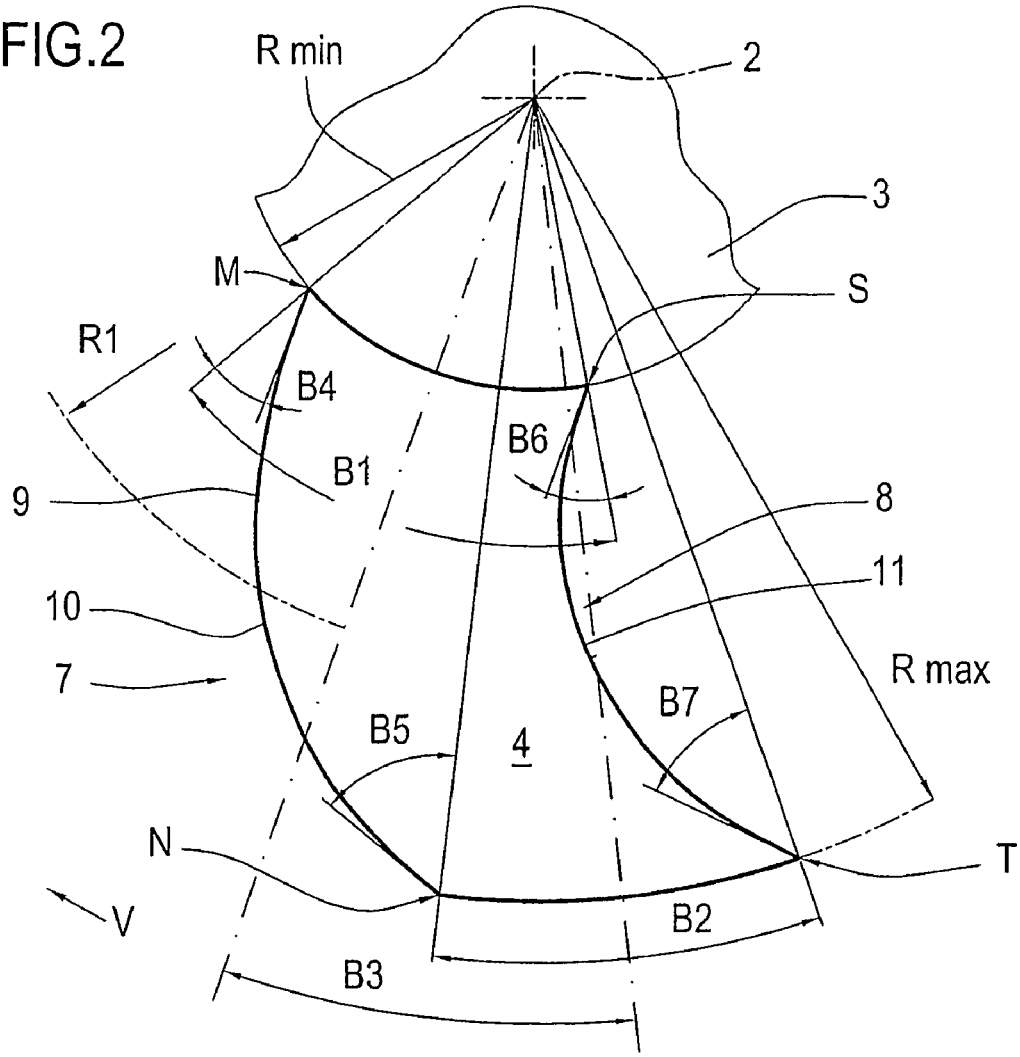
FIG. 2 is a schematic front view of a blade of the fan illustrated in the previous figure.

FIG. 2 illustrates an example of the geometric characteristics of a blade 4: the leading edge 7 is delimited by two circular arc segments 9, 10, and the trailing edge 8 is delimited by one circular arc segment 11. In the leading edge 7, a radius labelled R1 is the point of change from one circular arc segment to the other circular arc segment.

According to the example in FIG. 2, the general dimensions of the projection of a blade 4 in the plane XY are summarised in table 1:

TABLE 1

| dimensions of a blade 4. | | | |
|---|---|---|---|
| | Radius of internal segment (mm) | Radius of change (mm) | Radius of external segment (mm) |
| Leading edge (Ref. 7) | 133.57 (Ref. 9) | 97.75 (Ref. R1) | 83.23 (Ref. 10) |
| | Radius (mm) | | |
| Trailing edge (Ref. 8) | | 67.25 (Ref. 11) | |

The general geometric characteristics of the blade 4 are defined relative to a hub with 110 mm diameter, that is to say, the blade 4 has a minimum radius Rmin=55 mm at the root 5, and a 302 mm external diameter, giving it a maximum radius Rmax=151 mm at the tip 6, meaning that the blade 4 has a 96 mm radial extension.

As illustrated in the accompanying drawings, the outside of the fan may be fitted with a connecting ring 12 which may be several millimeters thick, meaning that the fan 1 in the example embodiment provided has an overall diameter of approximately 310 mm.

As is known, one of the functions of the connecting ring is to stiffen the outer part of the blades 4 so as to promote maintenance of the angles of angles of incidence and to improve the aerodynamic performance of the outer profiles of the blades, reducing the formation of vortices at the tip 6 of the blades 4.

However, it should be noticed that good results were also achieved using a fan made according to the present invention without the connecting ring.

Considering that the blade 4 has a minimum radius Rmin=55 mm and a maximum radius Rmax=151 mm, the leading edge 7 has a radius R1, where the change in the circular arc occurs, corresponding to around 44% of the radial extension of the leading edge 7, an extension which, as already indicated, is 96 mm.

The part 9 of the leading edge 7 closest to the root 5 consists of a circular arc with a radius equal to around 88% of the radius Rmax, and the part 10 of the leading edge 7 closest to the tip 6 consists of a circular arc segment with a radius equal to around 55% of the radius Rmax of the blade 4.

As regards the trailing edge 8, the circular arc segment 11 has a radius equal to around 44.5% of the radius Rmax of the blade 4.

The dimensions in percentages are summarised in table 2:

TABLE 2 blade 4 dimensions in percentage form.

| | Internal segment radius (% of Rmax) | Change radius (% of blade extension = Rmax − Rmin) | External segment radius (% of Rmax) |
|---|---|---|---|
| Leading edge (Ref. 7) | 88 (Ref. 9) | 44 (Ref. R1) | 55 (Ref. 10) |
| | Radius (% of Rmax) | | |
| Trailing edge (Ref. 8) | | 44.5 (Ref. 11) | |

Satisfactory results in terms of flow rate, pressure and noise were achieved even with values around these percentage dimensions. In particular, variations of 10% more or less on the above-mentioned dimensions are possible.

The percentage ranges relative to the dimensions are summarised in table 3:

TABLE 3

Blade 4 edges percentage ranges.

| | Internal segment radius (% of Rmax) | Change radius (% of blade extension = % of Rmax − Rmin) | External segment radius (% of Rmax) |
|---|---|---|---|
| Leading edge (Ref. 7) | 79-97 (Ref. 9) | 40-48.5 (Ref. R1) | 49.5-60.5 (Ref. 10) |
| | Radius (% Rmax) | | |
| Trailing edge (Ref. 8) | | 40-49 (Ref. 11) | |

For the leading edge 7, in the circular arc segment change zone, there may be a suitable fillet so that the edge 7 is continuous and free of cusps.

As regards the width or angular extension of the blades, again with reference to FIG. 2, the projection of the blade 4 in the plane XY has an amplitude, at the root 5, represented by an angle B1 of around 60 degrees and an amplitude, at the tip 6, represented by an angle B2 of around 26 degrees.

Again, satisfactory results were achieved in terms of flow rate, pressure and noise with values of angles B1, B2 around these values. In particular, variations of 10% more or less than the angles indicated are possible. The angle B1 may vary from 54 to 66 degrees, whilst the angle B2 may vary from 23 to 29 degrees.

In general, it must also be considered that, due to the plastic material used to make fans, variations in all of the dimensions and angles of 5% more or less must all be considered within the values indicated. Considering the respective bisecting lines and following the fan 1 direction of rotation V, the tip 6 is further back than the root 5 by an angle B3 of around 26 degrees.

Other angles characteristic of the blade 4 are angles B4, B5, B6, B7 (FIG. 2) formed by the respective tangents to the two edges 7, 8 and by the respective lines passing through points M, N, S, T: the angles B4 and B5 are respectively 28 and 54 degrees and the angles B6, B7 are respectively 28 and 45 degrees.

There may be between three and seven blades 4 and, according to a preferred embodiment, there are five blades 4 and they are separated by equal angles.

Each blade 4 consists of a set of aerodynamic profiles which gradually join up starting from the root 5 towards the tip 6.

Figure 3:
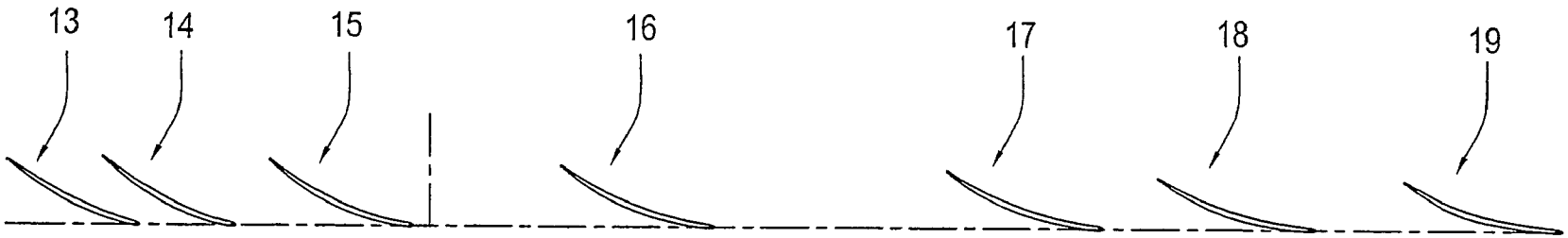
FIG. 3 is a cross-section of several profiles at various fan diameters.

FIG. 3 illustrates seven profiles 13-19, relative to respective sections at various intervals along the radial extension of a blade 4.

The profiles 13-19 are also formed by the geometric characteristics of which an example is provided in FIG. 4 for one of the profiles.

As illustrated in FIG. 4, each profile 13-19 is formed by a continuous centre line L1 without points of inflection or cusps and by a chord L2.

Each profile 13-19 is also formed by two angles BLE, BTE of incidence with the leading edge and with the trailing edge, said angles formed by the respective tangents to the centre line L1 at the point of intersection with the leading edge and with the trailing edge and a respective straight line perpendicular to the plane XY passing through the corresponding points of intersection.

With reference to the seven profiles 13-19, table 4 below indicates the angles of the leading edge BLE and of the trailing edge BTE, the length of the centre line L1 and the chord L2 of the profiles of a blade 4.

TABLE 4

Radial position, angles of leading and trailing edges, length of centre line and chord of the profiles of a blade 4.

| Profile | Radial extension (%) | Radius (mm) | BLE (degrees) | BTE (degrees) | L1 (centre line mm) | L2 (chord mm) |
|---|---|---|---|---|---|---|
| 13 | 0 | 55 | 78.47 | 55.15 | 64.12 | 63.66 |
| 14 | 17.9 | 72.15 | 81.38 | 49.31 | 65.37 | 64.53 |
| 15 | 44.5 | 97.75 | 82.93 | 48.46 | 69.40 | 68.30 |
| 16 | 71.2 | 123.35 | 83.53 | 51.96 | 73.28 | 73.31 |
| 17 | 81.5 | 133.27 | 83.99 | 53.96 | 73.95 | 73.04 |
| 18 | 97.9 | 148.95 | 84.82 | 54.96 | 72.63 | 71.64 |
| 19 | 100 | 151 | 85.28 | 54.85 | 72.18 | 71.14 |

It should be noticed that the thickness of each profile 13-9, 19, according to a typical trend of wing-shaped profiles, initially increases, reaching a maximum value S-MAX at around 40% of the length of the centre line L1, then it gradually decreases as far as the trailing edge 8.

In percentages, the thickness S-MAX is around 1.6% of the radius Rmax; the thickness of the profiles is distributed symmetrically relative to the centre line L1.

The positions of the profiles 13-19 relative to the radial extension of a blade 4 and the relative values for the thickness trend according to their position with respect to the centre line L1 are summarised in table 5.

TABLE 5

Radial position and thickness trend of blade 4 profiles.

| Profile | Extension (%) | Radius (mm) | S-MAX (mm) | Thickness dimensionless relative to S-MAX 0% L1 | 20% L1 | 40% L1 | 60% L1 | 80% L1 | 100% L1 |
|---|---|---|---|---|---|---|---|---|---|
| 13 | 0 | 55 | 2.45 | 0.681633 | 0.967347 | 1 | 0.808163 | 0.534694 | 0.2 |
| 14 | 17.9 | 72.15 | 2.45 | 0.681633 | 0.967347 | 1 | 0.808163 | 0.534694 | 0.2 |
| 15 | 44.5 | 97.75 | 2.45 | 0.681633 | 0.967347 | 1 | 0.808163 | 0.534694 | 0.2 |
| 16 | 71.2 | 123.35 | 2.45 | 0.681633 | 0.967347 | 1 | 0.808163 | 0.534694 | 0.2 |
| 17 | 81.5 | 133.27 | 2.45 | 0.681633 | 0.967347 | 1 | 0.808163 | 0.534694 | 0.2 |
| 18 | 97.9 | 148.95 | 2.45 | 0.681633 | 0.967347 | 1 | 0.808163 | 0.534694 | 0.2 |
| 19 | 100 | 151 | 2.45 | 0.681633 | 0.967347 | 1 | 0.808163 | 0.534694 | 0.2 |

Table 6 below summarises the actual mm values of the trend of thicknesses according to their position with respect to the centre line L1 for each profile 13-19 with reference to the embodiment illustrated.

TABLE 6

Thickness trend in mm of blade 4 profiles 13-19.

| Profile | Thickness (mm) 0% L1 | 20% L1 | 40% L1 | 60% L1 | 80% L1 | 100% L1 |
|---|---|---|---|---|---|---|
| 13 | 1.67 | 2.37 | 2.45 | 1.98 | 1.31 | 0.49 |
| 14 | 1.67 | 2.37 | 2.45 | 1.98 | 1.31 | 0.49 |
| 15 | 1.67 | 2.37 | 2.45 | 1.98 | 1.31 | 0.49 |
| 16 | 1.67 | 2.37 | 2.45 | 1.98 | 1.31 | 0.49 |
| 17 | 1.67 | 2.37 | 2.45 | 1.98 | 1.31 | 0.49 |
| 18 | 1.67 | 2.37 | 2.45 | 1.98 | 1.31 | 0.49 |
| 19 | 1.67 | 2.37 | 2.45 | 1.98 | 1.31 | 0.49 |

The profiles 13-19 are preferably delimited with a semi-circular fillet, on the leading edge 7 side, and with a truncation created using a segment of a straight line on the trailing edge 8 side.

In an alternative embodiment, good general performance was achieved in terms of the noise, flow rate and pressure supplied by the fan disclosed even with thicker profiles. According to said alternative embodiment, the positions of the profiles 13-19 relative to the radial extension of a blade and the relative thickness trend values according to their position with respect to the centre line L1 are summarised in table 7.

It should also be noticed that, in this embodiment, the thickness S-MAX is reached at 30% of the length of the centre line L1.

TABLE 7

Radial position and thickness trend of blade 4 profiles.

| Profile | Extension (%) | Radius (mm) | S-MAX (mm) | Thickness dimensionless relative to S-MAX 0% L1 | 20% L1 | 40% L1 | 60% L1 | 80% L1 | 100% L1 |
|---|---|---|---|---|---|---|---|---|---|
| 13 | 0 | 55 | 3.98 | 0.42 | 0.9486 | 0.9667 | 0.75 | 0.46 | 0.125 |
| 14 | 17.9 | 72.15 | 3.98 | 0.42 | 0.9486 | 0.9667 | 0.75 | 0.46 | 0.125 |
| 15 | 44.5 | 97.75 | 3.98 | 0.42 | 0.9486 | 0.9667 | 0.75 | 0.46 | 0.125 |
| 16 | 71.2 | 123.35 | 3.98 | 0.42 | 0.9486 | 0.9667 | 0.75 | 0.46 | 0.125 |
| 17 | 84.5 | 136.15 | 3.98 | 0.42 | 0.9486 | 0.9667 | 0.75 | 0.46 | 0.125 |
| 18 | 97.9 | 148.95 | 3.98 | 0.42 | 0.9486 | 0.9667 | 0.75 | 0.46 | 0.125 |
| 19 | 100 | 151 | 3.98 | 0.42 | 0.9486 | 0.9667 | 0.75 | 0.46 | 0.125 |

Table 8 below summarises the actual mm values of the trend of thicknesses according to their position with respect to the centre line L1 for each profile 13-19 relative to the embodiment illustrated in the accompanying drawings.

TABLE 8

Thickness trend in mm of blade 4 profiles 13-19.

| | Thickness (mm) | | | | | |
|---|---|---|---|---|---|---|
| Profile | 0% L1 | 20% L1 | 40% L1 | 60% L1 | 80% L1 | 100% L1 |
| 13 | 1.67 | 3.77 | 3.85 | 2.99 | 1.83 | 0.49 |
| 14 | 1.67 | 3.77 | 3.85 | 2.99 | 1.83 | 0.49 |
| 15 | 1.67 | 3.77 | 3.85 | 2.99 | 1.83 | 0.49 |
| 16 | 1.67 | 3.77 | 3.85 | 2.99 | 1.83 | 0.49 |
| 17 | 1.67 | 3.77 | 3.85 | 2.99 | 1.83 | 0.49 |
| 18 | 1.67 | 3.77 | 3.85 | 2.99 | 1.83 | 0.49 |
| 19 | 1.67 | 3.77 | 3.85 | 2.99 | 1.83 | 0.49 |

As may be seen, in both embodiments, the profiles 13-19 have the same thickness in the corresponding positions (0% of L1, 20% of L1, . . . , 80% of L1, etc.) along the extension of the centre line L1.

The first embodiment with the thinner profiles has advantages in terms of lightness, cost and ease of moulding.

The second embodiment with the thicker profiles has advantages in terms of aerodynamic efficiency, since the thicker profiles have better performance to prevent stalling.

The invention described may be subject to modifications and variations without thereby departing from the scope of the inventive concept described in the claims herein.

LIST OF REFERENCE CHARACTERS

| Reference | Description |
|---|---|
| 1 | AXIAL FAN |
| 2 | AXIS OF ROTATION |
| 3 | CENTRAL HUB |
| 4 | FAN 1 BLADE |
| 5 | BLADE 4 ROOT |
| 6 | BLADE 4 TIP |
| 7 | CONCAVE LEADING EDGE |
| 8 | CONVEX TRAILING EDGE |
| 9 | CIRCULAR ARC SEGMENT (INTERNAL) |
| 10 | CIRCULAR ARC SEGMENT (EXTERNAL) |
| 11 | CIRCULAR ARC SEGMENT |
| 12 | CONNECTING RING |
| 13-19 | AERODYNAMIC PROFILES |
| XY | ROTATION PLANE |
| V | DIRECTION OF ROTATION |
| R1 | RADIUS OF CHANGE BETWEEN SEGMENTS 9 AND 10 |
| XY | PROJECTION IN THE PLANE |
| B1-B7 | BLADE 4 CHARACTERISTIC ANGLES |
| M, N, S, T | BLADE 4 CHARACTERISTIC POINTS |
| L1 | CENTRE LINE |
| L2 | CHORD |
| BLE | LEADING EDGE ANGLES OF INCIDENCE |
| BTE | TRAILING EDGE ANGLES OF INCIDENCE |

The invention claimed is:

1. An axial fan (1), rotating in a direction (V) in a plane (XY) about an axis (2), comprising a central hub (3) with a radius (Rmin), a plurality of blades (4) each having a root (5), a tip (6) which extends to a tip radius (Rmax), the blades (4) being delimited by a convex leading edge (7) and a concave trailing edge (8), the axial fan being characterised in that the leading edge (7) comprises a first circular arc segment (9) close to the root (5) with a radius of between 79% and 97% of the tip radius (Rmax) and a second circular arc segment (10) close to the tip (6) with a radius of between 49.5% and 60.5% of the tip radius (Rmax), and a radius at the change between the two circular arc segments (9, 10) of between 40% and 48.5% of the extension (Rmax−Rmin) of the blade (4).

2. The axial fan (1) according to claim 1, characterised in that the trailing edge (8) comprises a circular arc segment (11) with a radius of between 40% and 49% of the tip radius (Rmax).

3. The axial fan (1) according to claim 1, characterised in that the leading edge (7) comprises a first circular arc segment (9) close to the root (5) with a radius which is 88% of the tip radius (Rmax) and a second circular arc segment (10) close to the tip (6) with a radius which is 55% of the tip radius (Rmax), and a radius at the change between the two circular arc segments (9, 10) which is 44% of the extension (Rmax−Rmin) of the blade (4).

4. The axial fan (1) according to claim 1, characterised in that the trailing edge (8) comprises a circular arc segment (11) with a radius which is 44.5% of the tip radius (Rmax).

5. The axial fan (1) according to claim 1, characterised in that the projection of the blade (4) in the plane (XY) has an amplitude, at the root (5), with an angle (B1) of between 54 and 66 degrees.

6. The axial fan (1) according to claim 1, characterised in that the projection of the blade (4) in the plane (XY) has an amplitude, at the tip (6), with an angle (B2) of between 23 and 29 degrees.

7. The axial fan (1) according to claim 1, characterised in that the projection of the blade (4) in the plane (XY) has an amplitude, at the root (5), with an angle (B2) of around 60 degrees.

8. The axial fan (1) according to claim 1, characterised in that the projection of the blade (4) in the plane (XY) has an amplitude, at the tip (6), with an angle (B2) of around 26 degrees.

9. The axial fan (1) according to claim 1, characterised in that, considering the projection of the blade (4) in the plane (XY) and fan (1) direction of rotation (V), the tip (6) is further back than the root (5) by an angle (B3) of around 26 degrees.

10. The axial fan (1) according to claim 1, characterised in that the projection of the blade (4) in the plane (XY) forms a point (M) of intersection between the leading edge (7) and the hub (3) with an angle (B4) of 28 degrees, the angle (B4) being formed by the respective tangent to the leading edge (7) at the point (M) and by a respective line from the axis (2) of the fan (1) passing through the point (M).

11. The axial fan (1) according to claim 1, characterised in that the projection of the blade (4) in the plane (XY) forms a point (N) of intersection between the leading edge (7) and the tip (6) with an angle (B5) of 54 degrees, the angle (B5) being formed by the respective tangent to the leading edge (7) at the point (N) and by a respective line from the axis (2) of the fan (1) passing through the point (N).

12. The axial fan (1) according to claim 1, characterised in that the projection of the blade (4) in the plane (XY) forms a point (S) of intersection between the trailing edge (8) and the hub (3) with an angle (B6) of 28 degrees, the angle (B6) being formed by the respective tangent to the trailing edge (8) at the point (S) and by a respective line from the axis (2) of the fan (1) passing through the point (S).

13. The axial fan (1) according to claim 1, characterised in that the projection of the blade (4) in the plane (XY) forms a point (T) of intersection between the trailing edge (8) and the tip (6) with an angle (B7) of 45 degrees, the angle (B5) being formed by the respective tangent to the trailing edge (8) at the point (T) and by a respective line from the axis (2) of the fan (1) passing through the point (T).

14. The axial fan (1) according to claim 1, characterised in that the blade (4) consists of at least several aerodynamic profiles (13-19) relative to respective sections at various intervals along the radial extension of a blade (4), each profile (13-19) being formed by a centre line (L1) which is continuous and without points of inflection or cusps and by two angles (BLE, BTE) of incidence with the leading edge and the trailing edge, the angles being formed by the respective tangents to the centre line (L1) at the point of intersection with the leading edge and with the trailing edge and a respective straight line perpendicular to the plane (XY) passing through the corresponding points of intersection and also being characterised in that the angles (BLE, BTE) of the profiles (13-19) have the values indicated in the following table:

| Profile | Radial extension (%) | Radius (mm) | BLE (degrees) | BTE (degrees) |
|---|---|---|---|---|
| 13 | 0 | 55 | 78.47 | 55.15 |
| 14 | 17.9 | 72.15 | 81.38 | 49.31 |
| 15 | 44.5 | 97.75 | 82.93 | 48.46 |
| 16 | 71.2 | 123.35 | 83.53 | 51.96 |
| 17 | 81.5 | 133.27 | 83.99 | 53.96 |
| 18 | 97.9 | 148.95 | 84.82 | 54.96 |
| 19 | 100 | 151 | 85.28 | 54.85. |

15. The axial fan (1) according to claim 1, characterised in that the blade (4) consists of at least several aerodynamic profiles (13-19), relative to respective sections at various intervals along the radial extension of a blade (4), each profile (13-19) being formed by a centre line (L1) which is continuous and free of points of inflection or cusps and also being characterised in that the profiles (13-19) have a thickness S-MAX equal to 1.6% of the tip radius Rmax.

16. The axial fan (1) according to claim 15, characterised in that the profiles (13-19) have a thickness which is arranged symmetrically relative to the centre line (L1) and a thickness trend that is initially increasing, a maximum value S-MAX at around 40% of the length of the centre line (L1), and then gradually decreasing as far as the trailing edge 8 and also being characterised in that the thickness trend is defined by the following table:

| Profile | Extension (%) | Radius (mm) | Dimensionless thickness relative to S-MAX 0% L1 | 20% L1 | 40% L1 | 60% L1 | 80% L1 | 100% L1 |
|---|---|---|---|---|---|---|---|---|
| 13 | 0 | 55 | 0.681633 | 0.967347 | 1 | 0.808163 | 0.534694 | 0.2 |
| 14 | 17.9 | 72.15 | 0.681633 | 0.967347 | 1 | 0.808163 | 0.534694 | 0.2 |
| 15 | 44.5 | 97.75 | 0.681633 | 0.967347 | 1 | 0.808163 | 0.534694 | 0.2 |
| 16 | 71.2 | 123.35 | 0.681633 | 0.967347 | 1 | 0.808163 | 0.534694 | 0.2 |
| 17 | 81.5 | 133.27 | 0.681633 | 0.967347 | 1 | 0.808163 | 0.534694 | 0.2 |
| 18 | 97.9 | 148.95 | 0.681633 | 0.967347 | 1 | 0.808163 | 0.534694 | 0.2 |
| 19 | 100 | 151 | 0.681633 | 0.967347 | 1 | 0.808163 | 0.534694 | 0.2. |

17. The axial fan (1) according to claim 1, characterised in that the blade (4) consists of at least several aerodynamic profiles (13-19), relative to respective sections at various intervals along the radial extension of a blade (4), each profile (13-19) being formed by a centre line (L1) which is continuous and free of points of inflection or cusps and also being characterised in that the profiles (13-19) have a thickness S-MAX equal to 2.6% of the tip radius Rmax.

18. The axial fan (1) according to claim 17, characterised in that the profiles (13-19) have a thickness that is arranged symmetrically relative to the centre line (L1) and a thickness trend that is initially increasing, a maximum value S-MAX at around 30% of the length of the centre line (L1), and then gradually decreasing as far as the trailing edge 8 and also being characterised in that the thickness trend is defined in the following table:

| Profile | Extension (%) | Radius (mm) | Dimensionless thickness relative to S-MAX 0% L1 | 20% L1 | 40% L1 | 60% L1 | 80% L1 | 100% L1 |
|---|---|---|---|---|---|---|---|---|
| 13 | 0 | 55 | 0.42 | 0.9486 | 0.9667 | 0.75 | 0.46 | 0.125 |
| 14 | 17.9 | 72.15 | 0.42 | 0.9486 | 0.9667 | 0.75 | 0.46 | 0.125 |
| 15 | 44.5 | 97.75 | 0.42 | 0.9486 | 0.9667 | 0.75 | 0.46 | 0.125 |
| 16 | 71.2 | 123.35 | 0.42 | 0.9486 | 0.9667 | 0.75 | 0.46 | 0.125 |
| 17 | 84.5 | 136.15 | 0.42 | 0.9486 | 0.9667 | 0.75 | 0.46 | 0.125 |
| 18 | 97.9 | 148.95 | 0.42 | 0.9486 | 0.9667 | 0.75 | 0.46 | 0.125 |
| 19 | 100 | 151 | 0.42 | 0.9486 | 0.9667 | 0.75 | 0.46 | 0.125. |

* * * * *

UNITED STATES PATENT AND TRADEMARK OFFICE

CERTIFICATE OF CORRECTION

PATENT NO. : 7,422,420 B2
APPLICATION NO. : 10/570169
DATED : September 9, 2008
INVENTOR(S) : Spaggiari It is certified that error appears in the above-identified patent and that said Letters Patent is hereby corrected as shown below:

Claim 7, Column 8, Line 36,
Please delete "angle (B2) of around"
and
replace with
-- angle (B1) of around --

Signed and Sealed this

Fourth Day of November, 2008

JON W. DUDAS
*Director of the United States Patent and Trademark Office*